US011805361B2

(12) United States Patent
Kalinichenko

(10) Patent No.: US 11,805,361 B2
(45) Date of Patent: Oct. 31, 2023

(54) METHOD FOR AUTOMATABLY OR AUTOMATED TUNING AT LEAST ONE OPERATIONAL PARAMETER OF AN ENGINE-ORDER-CANCELLATION APPARATUS

(71) Applicant: ASK Industries GmbH, Niederwinkling (DE)

(72) Inventor: Victor Kalinichenko, Viechtach (DE)

(73) Assignee: ASK Industries GmbH, Niederwinkling (DE)

( * ) Notice: Subject to any disclaimer, the term of this patent is extended or adjusted under 35 U.S.C. 154(b) by 0 days.

(21) Appl. No.: 17/763,504

(22) PCT Filed: Oct. 7, 2019

(86) PCT No.: PCT/EP2019/077034
§ 371 (c)(1),
(2) Date: Mar. 24, 2022

(87) PCT Pub. No.: WO2021/069052
PCT Pub. Date: Apr. 15, 2021

(65) Prior Publication Data
US 2022/0377459 A1 Nov. 24, 2022

(51) Int. Cl.
*H04R 3/04* (2006.01)

(52) U.S. Cl.
CPC ..... *H04R 3/04* (2013.01); *H04R 2499/13* (2013.01)

(58) Field of Classification Search
CPC ..... H04R 3/04; H04R 2499/13; G10K 11/17883; G10K 2210/121; G10K 2210/128; G10K 2210/1282; G10K 2210/3054; G10K 2210/3057
See application file for complete search history.

(56) References Cited

U.S. PATENT DOCUMENTS 5,701,349 A * 12/1997 Sano ..... G10K 11/17854 381/86
9,870,763 B1 * 1/2018 Christian ..... G10K 11/17833
2015/0010163 A1 1/2015 Ganeshkumar et al.
(Continued)

FOREIGN PATENT DOCUMENTS

WO 2018097946 A1 5/2018

OTHER PUBLICATIONS

Shujaat Khan et al.: "A Robust Variable Step Size Fractional Least Mean Square (RVSS-FLMS) Algorithm", arxiv.org, Cornell University Library, Ithaca, New York, Nov. 14, 2017. DOI: 10.1109/CSPA.2017.8064914, pp. 1-10.
(Continued)

*Primary Examiner* — Jason R Kurr
(74) *Attorney, Agent, or Firm* — Dinsmore & Shohl LLP

(57) ABSTRACT

Method for automatably or automated tuning at least one operational parameter of an engine-order-cancellation ("EOC") apparatus, the EOC apparatus being operable on the basis of a number of operational parameters, comprising the steps of: providing a defined tuning rule for automatably or automated tuning at least one operational parameter of an EOC apparatus, and automatably or automated tuning the at least one operational parameter of the EOC apparatus on basis of the provided tuning rule.

16 Claims, 1 Drawing Sheet

(56) References Cited

U.S. PATENT DOCUMENTS

2022/0014850 A1* 1/2022 Alcock ..... G10K 11/17813

OTHER PUBLICATIONS

Dariusz Bismor et al.: "Review and Comparison of Variable Step-Size LMS Algorithms", The International Journal of Acoustics and Vibration, Jan. 1, 2016. https://www.semanticscolar.org/paper/Review-and-Comparison-of-Variable-Step-Size-LMS-Bismor-Szyz/eddab6d8161b5282e6f41791473895d45b2bb8ef, pp. 24-38.

International Search Report & Written Opinion issued in corresponding PCT Application No. PCT/EP2019/077034 dated Jun. 26, 2020.

* cited by examiner

METHOD FOR AUTOMATABLY OR AUTOMATED TUNING AT LEAST ONE OPERATIONAL PARAMETER OF AN ENGINE-ORDER-CANCELLATION APPARATUS

CROSS-REFERENCE TO RELATED APPLICATIONS

The present specification is a National Phase Entry of International Application No. PCT/EP2019/077034 filed Oct. 7, 2019 and entitled "Method For Autobatably or Automated Tuning At Least One Operational Parameter Of An Engine-Order-Cancellation Apparatus" the entirety of which is incorporated by reference herein.

FIELD

The present specification relates to a method for automatably or automated tuning at least one operational parameter of an engine-order-cancellation apparatus, the engine-order-cancellation apparatus being operable on basis of a number of operational parameters.

BACKGROUND

Engine-order-cancellation ("EOC") apparatuses, which are sometimes also denoted as active-noise-cancellation ("ANC") apparatuses, are generally known from prior art.

The main purpose of respective EOC apparatuses is the reduction of undesired engine noise inside the car cabin which originates from the operation of the engine of the respective car. The frequency components of respective engine noise are typically, correlated to the engine speed (engine rpm) and its harmonics components (so called "orders"). This correlation relationship between the engine noise and the engine speed is used by respective EOC apparatuses for concertedly controlling, i.e. particularly reducing, the engine noise inside the car cabin.

Respective EOC apparatuses achieve the actual noise reduction by generating acoustic compensation signals that are typically, opposite in phase to the engine noise in the car cabin such that the engine noise in the car cabin is cancelled or reduced.

Respective EOC apparatuses typically, comprise a number of operational parameters which have to be tuned for a reliable and satisfactory engine noise cancellation inside the car cabin.

Yet, tuning of respective operational parameters is a highly cumbersome process which requires specially educated tuning personnel which manually tunes every operational parameter under different operating states of the engine, e.g. at different engine speeds, different engine torques, etc.

SUMMARY

It is therefore, the object of the present specification to provide an approach allowing for a more efficient, particularly an automated, tuning at least one operational parameter of an engine-order-cancellation apparatus.

This object is achieved by a method for automatably or automated tuning at least one operational parameter of an engine-order-cancellation apparatus, the engine-order-cancellation apparatus being operable on basis of a number of operational parameters, according to Claim 1. The Claims depending on Claim 1 refer to possible embodiments of the method according to Claim 1.

A first aspect is a method for automatably or automated tuning at least one operational parameter of an engine-order-cancellation ("EOC") apparatus, the EOC apparatus being operable on basis of a number of operational parameters.

The term "EOC apparatus" embraces any apparatus which is configured to cancel or reduce engine noise in a car cabin or vehicle cabin which engine noise results from operating an engine, i.e. typically a combustion engine, of the respective car or vehicle associated with the EOC apparatus. As such, the EOC apparatus may also be deemed or denoted as an active-noise-cancellation ("ANC") apparatus.

Respective EOC apparatuses which are tunable by the method described herein may be configured to generate acoustic compensation signals that are typically, opposite in phase to the engine noise in the car cabin of the respective car associated with the EOC apparatus.

As such, a respective EOC apparatus may comprise at least one hardware- and/or software embodied acoustic compensation signal generating device which is configured to generate acoustic compensation signals that are typically, opposite in phase to the engine noise in the car cabin, and at least one acoustic signal emitting device, such as a loudspeaker device, configured to emit respective acoustic compensation signals in the car cabin of the respective car associated with the EOC apparatus.

Typically, the EOC apparatus also comprises at least one acoustic signal recording device, such as a microphone device, configured to record engine noise in the car cabin of the respective car associated with the EOC apparatus.

A pair of at least one acoustic signal emitting device and at least one acoustically assigned acoustic recording device can build an acoustic channel of the EOC apparatus. The EOC apparatus may comprise a plurality of respective acoustic channels.

Operation of the EOC apparatus and its sub-units, i.e. the at least one acoustic compensation signal generating device, the at least one acoustic signal emitting device, and the at least one acoustic signal recording device is controlled via a hardware- and/or software embodied control unit of the EOC apparatus.

In either case, the EOC apparatus is operable or operated on basis of a number of operational parameters. These operational parameters have to be tuned for a reliable and satisfactory engine noise cancellation inside the car cabin of a car associated with the EOC apparatus. Examples of respective operational parameters are the step size ($\mu$-factor or -value) and the forgetting factor ($\lambda$-factor or -value).

The method described herein is directed to a special approach for (fully) automated tuning at least one operational parameter of an EOC apparatus which allows for omitting the cumbersome manual tuning by specially educated tuning personnel.

The method comprises the steps of providing a definable or defined tuning rule for automatably or automated tuning at least one operational parameter of an EOC apparatus, and automatably or automated tuning the at least one operational parameter of the EOC apparatus on basis of the provided tuning rule. The method may be implemented for a single operational parameter of the EOC apparatus (at at least one given operating state of the engine and/or for at least one acoustic channel of the EOC apparatus), a plurality of operational parameters of the EOC apparatus (at at least one given operating state of the engine and/or for at least one acoustic channel of the EOC apparatus), or all operational parameters of the EOC apparatus (at at least one given operating state of the engine and/or for at least one acoustic channel of the EOC apparatus).

In the first step of the method, a definable or defined tuning rule for automatably or automated tuning at least one operational parameter of an EOC apparatus is provided. The tuning rule typically comprises a defined sequence of processing rules or steps which have to be processed for automatably or automated tuning of a respective operational parameter of the EOC apparatus. The tuning rule and the respective processing rules or steps are typically, defined for tuning at least one specific operational parameter of the EOC apparatus at specific operating states of the engine the EOC apparatus is associated with and/or for specific acoustic channels of the EOC apparatus. As such, different tuning rules may be applied for tuning different operational parameters of the EOC apparatus and/or for different operating states of the engine the EOC apparatus is associated with and/or for a specific acoustic channel of the EOC apparatus.

A respective tuning rule may be embodied in hardware and/or software. A respective tuning rule may comprise a tuning algorithm which comprises at least one defined sequence of processing rules or steps which have to be processed for automatably or automated tuning of a respective operational parameter of the EOC apparatus.

A respective tuning rule may be particularly, provided on a machine-readable medium, e.g. a data carrier, comprising machine-readable instructions, that when executed by a processor of a hardware- and/or software-embodied control unit of an EOC apparatus being configured to implement the method, cause the EOC apparatus to carry out the method described herein.

In the second step of the method, the at least one operational parameter of the EOC apparatus is automatably or automated tuned on basis of the provided tuning rule. Hence, the second step comprises applying the tuning rule so as to tune the respective operational parameter of the EOC apparatus, particularly at a specific operating state of the engine the EOC apparatus is associated with and/or for a specific acoustic channel of the EOC apparatus. In particular, the second step comprises applying the tuning rule on the respective operational parameter of the EOC apparatus such that the respective operational parameter of the EOC apparatus is or will be automatically tuned, particularly at a specific operating state of the engine the EOC apparatus is associated with and/or for a specific acoustic channel of the EOC apparatus.

Depending on the concrete processing rules or steps defined in the respective applied tuning rule, the above steps of the method can be performed for tuning one or more operational parameters of the EOC apparatus, particularly at a specific operating state of the engine the EOC apparatus is associated with and/or for a specific acoustic channel of the EOC apparatus. In other words, a respective tuning rule may comprise processing rules or steps for tuning one, more, or all specific operational parameter of the EOC apparatus, particularly at a specific operating state of the engine the EOC apparatus is associated with and/or for a specific acoustic channel of the EOC apparatus.

The method thus, allows for an automated tuning of at least one operational parameter of an EOC apparatus which does not require cumbersome manual tuning by specially educated tuning personnel. The method thus, allows for efficiently tuning of at least one operational parameter of an EOC apparatus and is therefore, improved over existing approaches for tuning EOC apparatuses.

According to an exemplary embodiment of the method, a tuning rule which is provided and applied for tuning the at least one operational parameter of the EOC apparatus, particularly for at least one specific operating state of the engine, may comprise the steps of:

a) selecting a first value and a second value of a range of values for an operational parameter of the EOC apparatus which is to be tuned, b) applying a first processing rule, particularly a calculation rule, to the selected first and second values of the operational parameter of the EOC apparatus according to which the selected first and second values are summed up, whereby a sum of the selected first and second values is obtained;

c) applying a second processing rule, particularly a calculation rule, to the sum of the selected first and second values according to which the sum of the selected first and second values is divided by a divisional factor, whereby a result value is obtained;

d) determining if the EOC apparatus is operable or operated in a stable operating condition or in instable operating condition when operating the EOC apparatus on basis of the result value;

e) repeating steps b)-d) with the result value as the second value if it is determined that the EOC apparatus is operated in an instable operating condition when operating the EOC apparatus on basis of the result value, or repeating steps b)-d) with the result value as the first value if it is determined that the EOC apparatus is operated at a stable operating condition when operating the EOC apparatus on basis of the result value.

According to an exemplary embodiment of the method, a tuning rule which is provided and applied for tuning the at least one operational parameter of the EOC apparatus, particularly for at least one specific operating state of the engine, may comprise the steps of:

a) selecting a first value, the first value can be denoted as value A, and a second value, the second value can be denoted as value B, of a range of values for an operational parameter of the EOC apparatus which is to be tuned, whereby for a first type of tunable parameters of the EOC apparatus—this first type of tunable parameters can be denoted as Type1-parameters the first value A is assumed to be the one, where the EOC apparatus is (guaranteed) stable and the second value Bis assumed to be the one, where the EOC apparatus is (guaranteed) instable; or whereby for a second type of tunable parameters of the EOC apparatus—this second type of tunable parameters can be denoted as Type2-parameters—it is possible that the first value A is assumed to be the one, where the EOC apparatus is (guaranteed) instable, and the second value B is assumed to be the one, where the EOC apparatus is (guaranteed) stable; and assuming that the selected first and the second values A, B obey the condition: $A<B$;

b) applying a first processing rule, particularly a calculation rule, to the selected first and second values A, B of the operational parameter of the EOC apparatus according to which an in-between value C is obtained as the weighted sum of the selected first value A and the selected second values B using the weights w1 and (1−w1) as: $C=w1*A+(1-w1)*B$, where $0<w1<1$ is statically or dynamically selectable weight; in most common case $w1=0.5$;

c) determining if the EOC apparatus is operable or operated in a stable operating condition or in an instable operating condition when operating the EOC apparatus on basis of the result value C;

d) repeating steps b)-c) for Type1-parameters with the result value C as the new second value B, if it is determined that the EOC apparatus is operated in an instable operating condition when operating the EOC apparatus on basis of the result value C, or repeating steps b)-c) for Type1-parameters with the result value C as the new first value A, if it is determined that the EOC apparatus is operated at a stable operating condition when operating the EOC apparatus on basis of the result value C.

Alternatively, steps b)-c) may be repeated for Type2-parameters with the result value C as the new second value B, if it is determined that the EOC apparatus is operated in an instable operating condition when operating the EOC apparatus on basis of the result value C.

Alternatively, steps b)-c) may be repeated for Type2-parameters with the result value C as the new first value A, if it is determined that the EOC apparatus is operated at a stable operating condition when operating the EOC apparatus on basis of the result value C.

According to an exemplary embodiment of the method, an instable operating condition when operating the EOC apparatus on basis of the result value is typically given when it is determined that the EOC apparatus emits (or will emit) undesired, particularly audible, noise artefacts. In other words, the determination of emitting undesired, particularly audible, noise artefacts typically, represents an instable operating condition of the EOC apparatus. A suitable exemplary principle for detecting an instable operating condition when operating the EOC apparatus on basis of a respective result value is specified in the following application by the Applicant which was filed on the same day with the present Application: PCT/EP2019/077024.

According to an exemplary embodiment of the method, the above steps a) to c) of the tuning rule may be repeated until a specific stop condition is met. Hence, when the stop condition is met the implementation of the steps a) to e) of the tuning rule is at least temporarily stopped.

According to an exemplary embodiment of the method, the stop condition may be met when a difference between the last determined second value B and first value A exceeds above or below a predefined reference value. As such, a third processing rule, particularly a calculation rule, may be applied to the first and second values according to which the first value is subtracted from the second value, whereby a difference between the last determined first and second values is obtained; and applying a comparing rule to the obtained difference according to which the obtained difference is compared with a predefined reference value, whereby it is determined if difference between the last determined second value B and first value A is below a predefined reference value. Likewise, a respective reference value can be determined via tuning experiments, or based on technical specifications, e.g. predefined reference values, of the EOC apparatus. A respective reference value can also be a static or dynamic numerical value, i.e. be fixed, or, for example, be dependent on the operating state of the engine.

According to an exemplary embodiment of the method, the stop condition may be met when the operating state of the engine changes or is changed. An operating state of the engine may change when a load of the engine changes, for instance.

If the operating state of the engine is changed, the latest obtained values of A, B and C may be stored in a memory device. The latest obtained values of A, B and C may particularly, be stored in the specific place correspondent to the correspondent engine operating state. Steps a) to e) may be continued at the new operating state of the engine, if for that operating state the stop condition had not been met before.

According to an exemplary embodiment of the method, a respective result value C which for Type1-parameters is assigned to the respective first value A, or for Type2-parameters is assigned to the respective second value B, does, as follows from the steps a)-d), guarantee a stable condition of the EOC apparatus.

According to an exemplary embodiment of the method, a predefined offset-value may be applied. For example, for Type1-parameters, a pre-defined offset-value may be subtracted from the respective result value, which was determined from the respective first value. Fr Type2-parameters, a respective a pre-defined offset-value may be added to the respective result value, which was determined from the respective second value. By applying a respective predefined offset-value to the respective result value, which was determined from the respective difference of second and first values, being below the predefined reference value, operational safety of the tuned EOC apparatus can be increased since the application of the offset-value allows for creating a predefined "safety region" around the respective result value. A respective offset-value can also be a static (numerical) value or a dynamic (numerical) value, e.g. dependent on the operating state of the engine.

According to an exemplary embodiment of the method, the first value may be the last determined value at which stable operation of the EOC apparatus is determined and the second value for repeating steps may be the last determined value at which instable operation of the EOC apparatus is determined. This particularly applies for Type1-parameters. For Type2-parameters, the second value may be the last determined value at which stable operation of the EOC apparatus is determined and the first value for repeating steps may be the last determined value at which instable operation of the EOC apparatus is determined Hence, for Type1-parameters the first value can be deemed or denoted as a first threshold value at which stable operation of the EOC apparatus, particularly for a given operating state of the engine and/or for a given acoustic channel of the EOC apparatus and/or for a given harmonic order, is determined or possible, respectively and the second value can be deemed or denoted as a second threshold value at which instable operation of the EOC apparatus, particularly for the given operating state of the engine and/or for the given acoustic channel and/or for given harmonic order of the EOC apparatus, is determined. For Type2-parameters the first value can be deemed or denoted as a first threshold value at which instable operation of the EOC apparatus, particularly for a given operating state of the engine and/or for a given acoustic channel of the EOC apparatus and/or for a given harmonic order, is determined or possible, respectively and the second value can be deemed or denoted as a second threshold value at which stable operation of the EOC apparatus, particularly for the given operating state of the engine and/or for the given acoustic channel and/or for given harmonic order of the EOC apparatus, is determined. As such, the defined tuning rule may use respective stability values (first value) or instability values (second value) for tuning the at least one operational parameter of the EOC apparatus.

According to an exemplary embodiment of the method, zero may be used as a first initial first value. Using zero as a first initial value allows for an efficient initial implementation of the method.

According to an exemplary embodiment of the method, the tuning rule may be applied for a plurality of defined operating states of the engine the EOC apparatus whose at least one operational parameter is to be tuned is assignable or assigned to, particularly at a plurality of defined load states of the engine the EOC apparatus which is to be tuned is assignable or assigned to. As such, above steps a)-c) of the tuning rule may be performed for a plurality of defined operating states of the engine the EOC apparatus whose at least one operational parameter is to be tuned is assignable or assigned to, particularly at a plurality of defined load states of the engine the EOC apparatus which is to be tuned is assignable or assigned to. Respective operating states may be defined by different engine speeds (engine rpm), engine torques, engine loads, etc. Hence, a comprehensive tuning of a respective operational parameter of the EOC apparatus is feasible since the respective operational parameter of the EOC apparatus is tuned for different operating states of the respective engine.

According to an exemplary embodiment of the method, the tuning rule is applied for each acoustic channel of the EOC apparatus. As such, above steps a)-c) may be performed for each acoustic channel of the EOC apparatus. Hence, a comprehensive tuning of a respective operational parameter of the EOC apparatus is feasible since the respective operational parameter of the EOC apparatus is tuned for each acoustic channel of the EOC apparatus. As indicated above, a respective acoustic channel of the EOC apparatus is typically defined by an acoustic signal emitting device, e.g. a loudspeaker device, and an acoustic signal recording device, e.g. a microphone device, assigned to the signal emitting device.

According to an exemplary embodiment of the method, the tuning rule is applied for each engine harmonic which is to be cancelled by the EOC apparatus. As such, above steps a)-e) may be performed for each engine harmonic which is to be cancelled by the EOC apparatus. Hence, a comprehensive tuning of a respective operational parameter of the EOC apparatus is feasible since the respective operational parameter of the EOC apparatus is tuned for each engine harmonic which is to be cancelled by the EOC apparatus.

According to an exemplary embodiment of the method, the tuning rule may be applied for at least two different engine harmonics which are to be cancelled by the EOC apparatus simultaneously. As such, above steps a)-e) may be performed for at least two different engine harmonics which are to be cancelled by the EOC apparatus simultaneously. By applying the tuning rule and respective steps a)-e) simultaneously for at least two different engine harmonics which are to be cancelled by the EOC apparatus, the efficiency of the method can be increased since tuning can be accomplished for at least two at least two different engine harmonics which are to be cancelled by the EOC apparatus at the same time.

According to an exemplary embodiment of the method, the tuning rule may be applied while driving a vehicle comprising the engine the EOC apparatus whose at least one operational parameter is to be tuned is assignable or assigned to. As such, above steps a)-e) may be performed while driving a vehicle (car) comprising the engine the EOC apparatus whose at least one operational parameter is to be tuned is assignable or assigned to. Hence, the tuning may be accomplished while operating the vehicle comprising the engine the EOC apparatus whose at least one operational parameter is to be tuned is assignable or assigned to which omits the requirements of specific tuning infrastructure and allows for an in-situ tuning of operational parameter(s) of the EOC apparatus. Also, the tuning can be performed several times during the "life" of the EOC apparatus. As such, aging of the EOC apparatus, e.g. caused by aging effects, such as undesired oscillations at specific frequencies, of acoustic signal emitting devices, such as loudspeaker devices, can be made negligible by re-adjusting or re-tuning, respectively the corresponding operational parameter of the EOC apparatus. Such re-adjusting or re-tuning, respectively can be applied during operation of the vehicle or applied during a later tuning.

As indicated above, the forgetting factor is an example of a respective operational parameter of the EOC apparatus. As such, the operational parameter of the EOC apparatus which is to be tuned may be the forgetting factor of the EOC apparatus. Likewise, the step size is an example of a respective operational parameter of the EOC apparatus. As such, the operational parameter of the EOC apparatus is to be tuned may be the step size of the EOC apparatus.

Another aspect refers to an apparatus for automatably or automated tuning at least one operational parameter of an EOC apparatus. The apparatus comprises a control unit which is configured to, particularly in accordance with the method described herein, provide a defined tuning rule for automatably or automated tuning at least one operational parameter of an EOC apparatus, and automatably or automated tune the at least one operational parameter of the EOC apparatus on basis of the provided tuning rule. All annotations regarding the method also apply to the apparatus and vice versa.

According to an exemplary embodiment of the apparatus, the control unit may be configured to provide a tuning rule which comprises the steps of:

a) select a first value and a second value of a range of values for an operational parameter of the EOC apparatus which is to be tuned, b) apply a first processing rule, particularly a calculation rule, to the selected first and second values of the operational parameter of the EOC apparatus according to which the selected first and second values are summed up, whereby a sum of the selected first and second values is obtained;

c) apply a second processing rule, particularly a calculation rule, to the sum of the selected first and second values according to which the sum of the selected first and second values is divided by a divisional factor, whereby a result value is obtained;

d) determine if the EOC apparatus is operable or operated in a stable operating condition or in instable operating condition when operating the EOC apparatus on basis of the result value;

e) repeat steps b)-e) with the result value as the second value if it is determined that the EOC apparatus is operated in an instable operating condition when operating the EOC apparatus on basis of the result value, or repeat steps b)-e) with the result value as the first value if it is determined that the EOC apparatus is operated at a stable operating condition when operating the EOC apparatus on basis of the result value.

According to an exemplary embodiment of the apparatus, the control unit may be configured to provide and/or implement a tuning rule which comprises the steps of:

a) selecting a first value, the first value can be denoted as value A, and a second value, the second value can be denoted as value B, of a range of values for an operational parameter of the EOC apparatus which is to be tuned, whereby for a first type of tunable parameters of the EOC apparatus—this first type of tunable parameters can be denoted as Type1-parameters the first value A is assumed to be the one, where the EOC apparatus is (guaranteed) stable and the second value B is assumed to be the one, where the EOC apparatus is (guaranteed) instable; or whereby for a second type of tunable parameters of the EOC apparatus—this second type of tunable parameters can be denoted as Type2-parameters—it is possible that the first value A is assumed to be the one, where the EOC apparatus is (guaranteed) instable, and the second value B is assumed to be the one, where the EOC apparatus is (guaranteed) stable; and assuming that the selected first and the second values A, B obey the condition: A<B;

b) applying a first processing rule, particularly a calculation rule, to the selected first and second values A, B of the operational parameter of the EOC apparatus according to which an in-between value C is obtained as the weighted sum of the selected first value A and the selected second values B using the weights w1 and (1−w1) as: C=w1*A+(1−w1)*B, where 0<w1<1 is statically or dynamically selectable weight;

c) determining if the EOC apparatus is operable or operated in a stable operating condition or in an instable operating condition when operating the EOC apparatus on basis of the result value C;

d) repeating steps b)-c) for Type1-parameters with the result value C as the new second value B, if it is determined that the EOC apparatus is operated in an instable operating condition when operating the EOC apparatus on basis of the result value C, or repeating steps b)-c) for Type1-parameters with the result value C as the new first value A, if it is determined that the EOC apparatus is operated at a stable operating condition when operating the EOC apparatus on basis of the result value C.

Alternatively, the control unit may be configured to repeat steps b)-c) for Type2-parameters with the result value C as the new second value B, if it is determined that the EOC apparatus is operated in an instable operating condition when operating the EOC apparatus on basis of the result value C.

Alternatively, the control unit may be configured to repeat steps b)-c) for Type2-parameters with the result value C as the new first value A, if it is determined that the EOC apparatus is operated at a stable operating condition when operating the EOC apparatus on basis of the result value C.

According to an exemplary embodiment of the apparatus, the control unit may further comprise a hardware- and/or software embodied selection unit for selecting a first value and a second value of a range of values for a specific operational parameter of the EOC apparatus which is to be tuned, and a hardware- and/or software embodied processing unit, particularly a calculation unit, for applying a respective first processing rule, particularly a calculation rule, to the selected first and second values of the operational parameter of the EOC apparatus so as to obtain a result value; and a hardware- and/or software embodied a determination unit for determining if the EOC apparatus is operable or operated in a stable operating condition or in instable operating condition when operating the EOC apparatus on basis of the result value.

Another aspect refers to an EOC apparatus for a vehicle, particularly a car, the EOC apparatus comprising at least one apparatus for automatably or automated tuning at least one operational parameter of an EOC apparatus as described herein. All annotations regarding the apparatus also apply to the EOC apparatus and vice versa.

Another aspect refers to a vehicle, particularly a car, comprising at least one engine, particularly a combustion engine, and an EOC apparatus as described herein. All annotations regarding the EOC apparatus also apply to the vehicle and vice versa.

BRIEF DESCRIPTION OF THE DRAWINGS

Exemplary embodiments are described with reference to the Figures, whereby.

DETAILED DESCRIPTION

Figure 1:
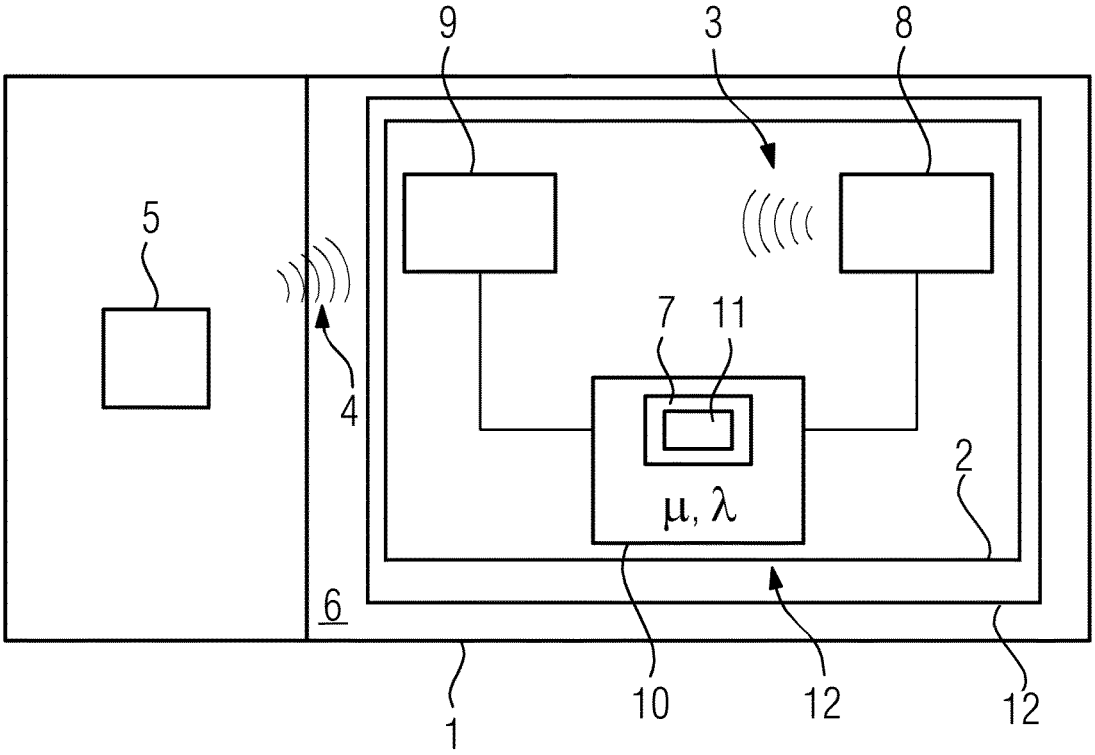
FIG. 1 shows a principle drawing of a vehicle comprising an EOC apparatus according to an exemplary embodiment.

FIG. 1 shows a principle drawing of a vehicle 1 (car) comprising an EOC apparatus 2 according to an exemplary embodiment. As will be apparent from below, the EOC apparatus 2 is configured to implement a method for automatably or automated tuning at least one operational parameter of the EOC apparatus 2.

The EOC apparatus 2 is configured to generate acoustic compensation signals 3 that are typically, opposite in phase to the engine noise 4 in the car cabin 6 of the vehicle 1 associated with the EOC apparatus 2. The engine noise 4 originates from operation of the engine 5 of the vehicle 1.

The EOC apparatus 2 comprises at least one hardware- and/or software embodied acoustic compensation signal generating device 7 which is configured to generate acoustic compensation signals 3 that are typically, opposite in phase to the engine noise 4 in the car cabin 6 at at least one acoustic signal recording device point, such as microphone device, by at least one acoustic signal emitting device 8, such as a loudspeaker device, configured to emit respective acoustic compensation signals 3 in the car cabin 6, and at least one acoustic signal recording device 9, such as a microphone device, configured to record engine noise 4 in the car cabin 6.

A pair of at least one acoustic signal emitting device 8 and at least one acoustically assigned acoustic recording device 9 can build an acoustic channel of the EOC apparatus 2. The EOC apparatus 2 may comprise a plurality of respective acoustic channels.

Operation of the EOC apparatus 2 and its sub-units, i.e. the acoustic compensation signal generating device 7, the at least one acoustic signal emitting device 8, and the at least one acoustic signal recording device 9 is controlled via a hardware- and/or software embodied control unit 10 of the EOC apparatus 2.

In either case, the EOC apparatus 2 is operable or operated on basis of a number of operational parameters. These operational parameters have to be tuned for a reliable and satisfactory engine noise cancellation inside the car cabin 6 of the vehicle 1 associated with the EOC apparatus 2. Examples of respective operational parameters are the step size (μ-factor or -value) and the forgetting factor (λ-factor or -value). Typically, every operational parameter is individual for a specific engine order and for a specific acoustic channel.

The method which is or can be implemented via the EOC apparatus allows for a special approach for (partially or fully) automated tuning at least one operational parameter of the EOC apparatus 2 which allows for omitting the cumbersome manual tuning by specially educated tuning personnel.

The method comprises the steps of providing a definable or defined tuning rule for automatably or automated tuning at least one operational parameter of the EOC apparatus 2, and automatably or automated tuning the at least one operational parameter of the EOC apparatus 2 on basis of the provided tuning rule. The method may be implemented for a single operational parameter of the EOC apparatus 2 (at at least one given operating state of the engine 5 and/or for at least one acoustic channel of the EOC apparatus 2), a plurality of operational parameters of the EOC apparatus 2 (at at least one given operating state of the engine 5 and/or for at least one acoustic channel of the EOC apparatus 2), or all operational parameters of the EOC apparatus 2 (at at least one given operating state of the engine 5 and/or for at least one acoustic channel of the EOC apparatus 2).

In the first step of the method, a definable or defined tuning rule for automatably or automated tuning at least one operational parameter of the EOC apparatus 2 is provided. The tuning rule typically comprises a defined sequence of processing rules or steps which have to be processed for automatably or automated tuning of a respective operational parameter of the EOC apparatus 2. The tuning rule and the respective processing rules or steps are typically, defined for tuning at least one specific operational parameter of the EOC apparatus 2 at at least one specific operating state of the engine 5 the EOC apparatus 2 is associated with and/or for a specific acoustic channel of the EOC apparatus 2. As such, different tuning rules may be applied for tuning different operational parameters of the EOC apparatus 2 and/or for different operating states of the engine 5 the EOC apparatus 2 is associated with and/or for a specific acoustic channel of the EOC apparatus 2.

A respective tuning rule may be embodied in hardware and/or software. A respective tuning rule may comprise a tuning algorithm which comprises at least one defined sequence of processing rules or steps which have to be processed for automatably or automated tuning of a respective operational parameter of the EOC apparatus 2.

A respective tuning rule may be particularly, provided on a machine-readable medium 11, e.g. a data carrier, comprising machine-readable instructions, that when executed by a processor of the hardware- and/or software-embodied control unit 10 of the EOC apparatus 2 being configured to implement the method, cause the EOC apparatus 2 to carry out the method.

In the second step of the method, the at least one operational parameter of the EOC apparatus 2 is automatably or automated tuned on basis of the provided tuning rule. Hence, the second step comprises applying the tuning rule so as to tune the respective operational parameter of the EOC apparatus 2, particularly at a specific operating state of the engine 5 the EOC apparatus 2 is associated with and/or for a specific acoustic channel of the EOC apparatus 2. In particular, the second step comprises applying the tuning rule on the respective operational parameter of the EOC apparatus 2 such that the respective operational parameter of the EOC apparatus 2 is or will be automatically tuned, particularly at a specific operating state of the engine 5 the EOC apparatus 2 is associated with and/or for a specific acoustic channel of the EOC apparatus 2.

Depending on the concrete processing rules or steps defined in the respective applied tuning rule, the above steps of the method can be performed for tuning one or more operational parameters of the EOC apparatus 2, particularly at a specific operating state of the engine 5 the EOC apparatus 2 is associated with and/or for a specific acoustic channel of the EOC apparatus 2. In other words, a respective tuning rule may comprise processing rules or steps for tuning one, more, or all specific operational parameter of the EOC apparatus 2, particularly at a specific operating state of the engine 5 the EOC apparatus 2 is associated with and/or for a specific acoustic channel of the EOC apparatus 2.

The method thus, allows for an automated tuning of at least one operational parameter of the EOC apparatus 2 which does not require cumbersome manual tuning by specially educated tuning personnel. The method thus, allows for efficiently tuning of at least one operational parameter of an EOC apparatus 2 and is therefore, improved over existing approaches for tuning EOC apparatuses.

According to the exemplary embodiment of the method, a tuning rule which is provided and applied for tuning the at least one operational parameter of the EOC apparatus 2, particularly for at least one specific operating state of the engine 5, may comprise the steps of:

a) selecting a first value and a second value of a range of values for an operational parameter of the EOC apparatus 2 which is to be tuned, b) applying a first processing rule, particularly a calculation rule, to the selected first and second values of the operational parameter of the EOC apparatus 2 according to which the selected first and second values are summed up, whereby a sum of the selected first and second values is obtained;

c) applying a second processing rule, particularly a calculation rule, to the sum of the selected first and second values according to which the sum of the selected first and second values is divided by a divisional factor, e.g. two, whereby a result value is obtained;

d) determining if the EOC apparatus 2 is operable or operated in a stable operating condition or in instable operating condition when operating the EOC apparatus 2 on basis of the result value;

e) repeating steps b)-e) with the result value as the second value if it is determined that the EOC apparatus 2 is operated in an instable operating condition when operating the EOC apparatus 2 on basis of the result value, or repeating steps b)-e) with the result value as the first value if it is determined that the EOC apparatus 2 is operated at a stable operating condition when operating the EOC apparatus 2 on basis of the result value.

According to an exemplary embodiment of the method, a tuning rule which is provided and applied for tuning the at least one operational parameter of the EOC apparatus 2, particularly for at least one specific operating state of the engine 5, may comprise the steps of:

a) selecting a first value, the first value can be denoted as value A, and a second value, the second value can be denoted as value B, of a range of values for an operational parameter of the EOC apparatus 2 which is to be tuned, whereby for a first type of tunable parameters of the EOC apparatus 2—this first type of tunable parameters can be denoted as Type1-parameters the first value A is assumed to be the one, where the EOC apparatus 2 is (guaranteed) stable and the second value B is assumed to be the one, where the EOC apparatus 2 is (guaranteed) instable; or whereby for a second type of tunable parameters of the EOC apparatus 2—this second type of tunable parameters can be denoted as Type2-parameters—it is possible that the first value A is assumed to be the one, where the EOC apparatus 2 is (guaranteed) instable, and the second value B is assumed to be the one, where the EOC apparatus 2 is (guaranteed) stable; and assuming that the selected first and the second values A, B obey the condition: $A<B$;

b) applying a first processing rule, particularly a calculation rule, to the selected first and second values A, B of the operational parameter of the EOC apparatus 2 according to which an in-between value C is obtained as the weighted sum of the selected first value A and the selected second values B using the weights w1 and (1−w1) as: $C=w1*A+(1-w1)*B$, where $0<w1<1$ is statically or dynamically selectable weight; in most common case $w1=0.5$;

c) determining if the EOC apparatus 2 is operable or operated in a stable operating condition or in an instable operating condition when operating the EOC apparatus 2 on basis of the result value C;

d) repeating steps b)-c) for Type1-parameters with the result value C as the new second value B, if it is determined that the EOC apparatus 2 is operated in an instable operating condition when operating the EOC apparatus 2 on basis of the result value C, or repeating steps b)-c) for Type1-parameters with the result value C as the new first value A, if it is determined that the EOC apparatus 2 is operated at a stable operating condition when operating the EOC apparatus 2 on basis of the result value C.

Alternatively, steps b)-c) may be repeated for Type2-parameters with the result value C as the new second value B, if it is determined that the EOC apparatus 2 is operated in an instable operating condition when operating the EOC apparatus 2 on basis of the result value C.

Alternatively, steps b)-c) may be repeated for Type2-parameters with the result value C as the new first value A, if it is determined that the EOC apparatus 2 is operated at a stable operating condition when operating the EOC apparatus 2 on basis of the result value C.

According to the exemplary embodiment of the method, the first and second values are typically, numeric values. Thereby, the first value is typically, lower compared with the second value. Thus, the first value is typically, a low(er) value (compared with the second value), the second value is typically, a high(er) value (compared with the first value).

According to the exemplary embodiment of the method, an instable operating condition when operating the EOC apparatus 2 on basis of the result value is given when it is determined that the EOC apparatus 2 emits (or will emit) undesired, particularly audible, noise artefacts. In other words, the determination of emitting undesired, particularly audible, noise artefacts may represent an instable operating condition of the EOC apparatus 2.

According to an exemplary embodiment of the method, the above steps a) to c) of the tuning rule may be repeated until a specific stop condition is met. Hence, when the stop condition is met the implementation of the steps a) to e) of the tuning rule is at least temporarily stopped.

According to an exemplary embodiment of the method, the above steps a) to c) of the tuning rule may be repeated until a specific stop condition is met. Hence, when the stop condition is met the implementation of the steps a) to e) of the tuning rule is at least temporarily stopped.

According to an exemplary embodiment of the method, the stop condition may be met when a difference between the last determined second value B and first value A exceeds above or below a predefined reference value. As such, a third processing rule, particularly a calculation rule, may be applied to the first and second values A, B according to which the first value A is subtracted from the second value B, whereby a difference between the last determined first and second values A, B is obtained; and applying a comparing rule to the obtained difference according to which the obtained difference is compared with a predefined reference value, whereby it is determined if difference between the last determined second value B and first value A is below a predefined reference value. Likewise, a respective reference value can be determined via tuning experiments, or based on technical specifications, e.g. predefined reference values, of the EOC apparatus 2. A respective reference value can also be a static or dynamic numerical value, i.e. be fixed, or, for example, be dependent on the operating state of the engine 5.

According to an exemplary embodiment of the method, the stop condition may be met when the operating state of the engine 5 changes or is changed. An operating state of the engine 5 may change when a load of the engine changes, for instance.

If the operating state of the engine 5 is changed, the latest obtained values of A, B and C may be stored in a memory device. The latest obtained values of A, B and C may particularly, be stored in the specific place correspondent to the correspondent engine operating state. Steps a) to e) may be continued at the new operating state of the engine 5, if for that operating state the stop condition had not been met before.

According to an exemplary embodiment of the method, a respective result value C which for Type1-parameters is assigned to the respective first value A, or for Type2-parameters is assigned to the respective second value B, does, as follows from the steps a)-d), guarantee a stable condition of the EOC apparatus 2.

According to an exemplary embodiment of the method, a predefined offset-value may be applied. For example, for Type1-parameters, a pre-defined offset-value may be subtracted from the respective result value, which was determined from the respective first value. For Type2-parameters, a respective a pre-defined offset-value may be added to the respective result value, which was determined from the respective second value. By applying a respective predefined offset-value to the respective result value, which was determined from the respective difference of second and first values, being below the predefined reference value, operational safety of the tuned EOC apparatus 2 can be increased since the application of the offset-value allows for creating a predefined "safety region" around the respective result value. A respective offset-value can also be a static (numerical) value or a dynamic (numerical) value, e.g. dependent on the operating state of the engine.

According to an exemplary embodiment of the method, the first value may be the last determined value at which stable operation of the EOC apparatus is determined and the second value for repeating steps may be the last determined value at which instable operation of the EOC apparatus 2 is determined. This particularly applies for Type1-parameters. For Type2-parameters, the second value may be the last determined value at which stable operation of the EOC apparatus is determined and the first value for repeating steps may be the last determined value at which instable operation of the EOC apparatus is determined Hence, for Type1-parameters the first value can be deemed or denoted as a first threshold value at which stable operation of the EOC apparatus, particularly for a given operating state of the engine and/or for a given acoustic channel of the EOC apparatus and/or for a given harmonic order, is determined or possible, respectively and the second value can be deemed or denoted as a second threshold value at which instable operation of the EOC apparatus 2, particularly for the given operating state of the engine and/or for the given acoustic channel and/or for given harmonic order of the EOC apparatus 2, is determined. For Type2-parameters the first value can be deemed or denoted as a first threshold value at which instable operation of the EOC apparatus 2, particularly for a given operating state of the engine and/or for a given acoustic channel of the EOC apparatus 2 and/or for a given harmonic order, is determined or possible, respectively and the second value can be deemed or denoted as a second threshold value at which stable operation of the EOC apparatus 2, particularly for the given operating state of the engine and/or for the given acoustic channel and/or for given harmonic order of the EOC apparatus 2, is determined. As such, the defined tuning rule may use respective stability values (first value) or instability values (second value) for tuning the at least one operational parameter of the EOC apparatus 2.

According to the exemplary embodiment of the method, zero may be used as a first initial first value. Using zero as a first initial value allows for an efficient initial implementation of the method.

According to the exemplary embodiment of the method, the tuning rule may be applied for a plurality of defined operating states of the engine 5 the EOC apparatus 2 whose at least one operational parameter is to be tuned is assignable or assigned to, particularly at a plurality of defined load states of the engine the EOC apparatus 2 which is to be tuned is assignable or assigned to, and/or for a plurality of acoustic channels of the EOC apparatus 2. As such, above steps a)-e) of the respective tuning rule may be performed for a plurality of defined operating states of the engine 5 the EOC apparatus 2 whose at least one operational parameter is to be tuned is assignable or assigned to, particularly at a plurality of defined load states of the engine the EOC apparatus 2 which is to be tuned is assignable or assigned to, and/or for a plurality of acoustic channels of the EOC apparatus 2. Respective operating states may be defined by different engine speeds (engine rpm), engine torques, engine loads, etc. Hence, a comprehensive tuning of a respective operational parameters of the EOC apparatus 2 is feasible since the respective operational parameter of the EOC apparatus 2 is tuned for different operating states of the respective engine 5 and/or for a plurality of acoustic channels of the EOC apparatus 2 and/or for a plurality of engine harmonics of the engine 5.

According to the exemplary embodiment of the method, the tuning rule is applied for each acoustic channel of the EOC apparatus 2. As such, above steps a)-e) may be performed for each acoustic channel of the EOC apparatus 2. Hence, a comprehensive tuning of a respective operational parameter of the EOC apparatus 2 is feasible since the respective operational parameter of the EOC apparatus 2 is tuned for each acoustic channel of the EOC apparatus 2.

According to the exemplary embodiment of the method, the tuning rule is applied for each engine harmonic which is to be cancelled by the EOC apparatus 2. As such, above steps a)-e) may be performed for each engine harmonic which is to be cancelled by the EOC apparatus 2. Hence, a comprehensive tuning of a respective operational parameter of the EOC apparatus 2 is feasible since the respective operational parameter of the EOC apparatus 2 is tuned for each engine harmonic which is to be cancelled by the EOC apparatus 2.

According to the exemplary embodiment of the method, the tuning rule may be applied for at least two different engine harmonics which are to be cancelled by the EOC apparatus 2 simultaneously. As such, above steps a)-e) may be performed for at least two different engine harmonics which are to be cancelled by the EOC apparatus 2 simultaneously. By applying the tuning rule and respective steps a)-e) simultaneously for at least two different engine harmonics which are to be cancelled by the EOC apparatus 2, the efficiency of the method can be increased since tuning can be accomplished for at least two at least two different engine harmonics which are to be cancelled by the EOC apparatus 2 at the same time.

According to the exemplary embodiment of the method, the tuning rule may be applied while driving the vehicle 1 comprising the engine 5 the EOC apparatus 2 whose at least one operational parameter is to be tuned is assignable or assigned to. As such, above steps a)-e) may be performed while driving the vehicle 1 comprising the engine 5 the EOC apparatus 2 whose at least one operational parameter is to be tuned is assignable or assigned to. Hence, the tuning may be accomplished while operating the vehicle 1 comprising the engine 5 the EOC apparatus 2 whose at least one operational parameter is to be tuned is assignable or assigned to which omits the requirements of specific tuning infrastructure and allows for an in-situ tuning of operational parameter(s) of the EOC apparatus 2. Also, the tuning can be performed several times during the "life" of the EOC apparatus 2. As such, aging of the EOC apparatus 2, e.g. caused by aging effects, such as undesired oscillations at specific frequencies, of acoustic signal emitting devices 8, such as loudspeaker devices, can be made negligible by re-adjusting or re-tuning, respectively the corresponding operational parameter of the EOC apparatus 2. Such re-adjusting or re-tuning, respectively can be applied during operation of the vehicle 1 or applied during a later tuning.

As indicated above, the forgetting factor is an example of a respective EOC. As such, the operational parameter which is to be tuned may be the forgetting factor of the EOC apparatus.

The control unit 10 may form part of an apparatus 12 for automatably or automated tuning at least one operational parameter of an EOC apparatus 2. The apparatus 12 thus, comprises the control unit 10 which is configured to, particularly in accordance with the method described herein, provide a defined tuning rule for automatably or automated tuning at least one operational parameter of an EOC apparatus 2, and automatably or automated tune the at least one operational parameter of the EOC apparatus 2 on basis of the provided tuning rule. All annotations regarding the method also apply to the apparatus and vice versa.

Figure 2:
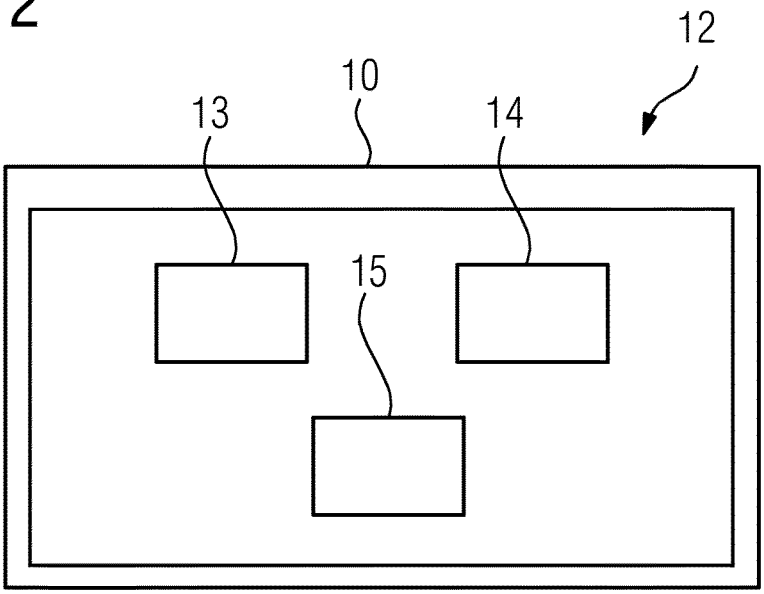
FIG. 2 shows a principle drawing of an apparatus for automatably or automated tuning at least one operational parameter of an EOC apparatus according to an exemplary embodiment.

FIG. 2 shows a principle drawing of an apparatus for automatably or automated tuning at least one operational parameter of an EOC apparatus 2 according to an exemplary embodiment.

According to the exemplary embodiment of the apparatus 12, the control unit 10 may be configured to provide and/or implement a tuning rule which comprises the steps of:

a) select a first value and a second value of a range of values for an operational parameter of the EOC apparatus 2 which is to be tuned, b) apply a first processing rule, particularly a calculation rule, to the selected first and second values of the operational parameter of the EOC apparatus 2 according to which the selected first and second values are summed up, whereby a sum of the selected first and second values is obtained;

c) apply a second processing rule, particularly a calculation rule, to the sum of the selected first and second values according to which the sum of the selected first and second values is divided by a divisional factor, whereby a result value is obtained;

d) determine if the EOC apparatus 2 is operable or operated in a stable operating condition or in instable operating condition when operating the EOC apparatus 2 on basis of the result value;

e) repeat steps b)-e) with the result value as the second value if it is determined that the EOC apparatus 2 is operated in an instable operating condition when operating the EOC apparatus 2 on basis of the result value, or repeat steps b)-e) with the result value as the first value if it is determined that the EOC apparatus 2 is operated at a stable operating condition when operating the EOC apparatus 2 on basis of the result value.

According to the exemplary embodiment of the apparatus 12, the control unit 10 may be configured to provide and/or implement a tuning rule which comprises the steps of:

a) selecting a first value, the first value can be denoted as value A, and a second value, the second value can be denoted as value B, of a range of values for an operational parameter of the EOC apparatus (2) which is to be tuned, whereby for a first type of tunable parameters of the EOC apparatus ("Type1-parameters") the first value A is assumed to be the one, where the EOC apparatus is stable and the second value B is assumed to be the one, where the EOC apparatus is instable; or whereby for a second type of tunable parameters of the EOC apparatus 2 ("Type2-parameters") the first value A is assumed to be the one, where the EOC apparatus (2) is instable, and the second value B is assumed to be the one, where the EOC apparatus 2 is stable; and assuming that the selected first and the second values A, B obey the condition: A<B;

b) applying a first processing rule, particularly a calculation rule, to the selected first and second values A, B of the operational parameter of the EOC apparatus (2) according to which an in-between value C is obtained as the weighted sum of the selected first value A and the selected second values B using the weights w1 and (1−w1) as: C=w1*A+(1−w1)*B, where 0<w1<1 is statically or dynamically selectable weight;

c) determining if the EOC apparatus 2 is operable or operated in a stable operating condition or in an instable operating condition when operating the EOC apparatus 2 on basis of the result value C;

d) repeating steps b)-c) for Type1-parameters with the result value C as the new second value B, if it is determined that the EOC apparatus 2 is operated in an instable operating condition when operating the EOC apparatus 2 on basis of the result value C, or repeating steps b)-c) for Type1-parameters with the result value C as the new first value A, if it is determined that the EOC apparatus 2 is operated at a stable operating condition when operating the EOC apparatus 2 on basis of the result value C.

According to an exemplary embodiment of the apparatus 2, the control unit 10 may further comprise a hardware- and/or software embodied selection unit 13 for selecting a first value and a second value of a range of values for a specific operational parameter of the EOC apparatus 2 which is to be tuned, and a hardware- and/or software embodied processing unit 14, particularly a calculation unit, for applying a respective first processing rule, particularly a calculation rule, to the selected first and second values of the operational parameter of the EOC apparatus 2 so as to obtain a result value; and a hardware- and/or software embodied a determination unit 15 for determining if the EOC apparatus 2 is operable or operated in a stable operating condition or in instable operating condition when operating the EOC apparatus 2 on basis of the result value.

Below given is an example of how an exemplary tuning rule may be applied for tuning the step size (μ-value) as an example of a respective operational parameter of the EOC apparatus 2.

The tuning rule may use $\mu_L$ as a first value and $\mu_R$ as second value. $\mu_L$ may refer to the (highest) found stable value of the EOC apparatus 2, $\mu_R$ may refer to the (lowest) found instable value of the EOC apparatus 2.

Now, for a given engine speed (engine rpm) and engine torque of the engine 5, the tuning rule applies the following processing rule for determining a $\mu_0$-value which can be deemed as a result value:

$$(\mu_L+\mu_R)/2$$

In this processing rule, the divisional factor is 2.

If the $\mu_0$-value results in a stable operation of the EOC apparatus 2, the $\mu_0$-value is used as the new $\mu_L$ in a further iteration of the above processing rule. Otherwise, i.e. if the $\mu_0$-value results in an instable operation of the EOC apparatus 2, the $\mu_0$-value is used as the new $\mu_R$ in a further iteration of the above processing rule.

The processing rule can be stopped when a stop condition is met. This can be the case when $\mu_L-\mu_R<\varepsilon$ (with $\varepsilon>0$ being the desired precision of the respective operational parameter of the EOC apparatus 2). F can be deemed as a predefined reference value. The stop condition may thus, be met when a difference between the last determined first and second values $\mu_L$, $\mu_R$ exceeds above or below a predefined reference value F.

Further, an offset value σ can be applied to the latest $\mu_0$-value. Particularly, the offset value σ can be subtracted from the latest $\mu_0$-value such that the final value $\mu_{final}$=the latest $\mu_0$-value −σ. Applying a respective offset-value increases the operational stability of the EOC apparatus 2.

The invention claimed is:

1. A method for automatably or automated tuning of at least one operational parameter of an engine-order-cancellation (EOC) apparatus, the EOC apparatus being operable on a basis of a number of operational parameters, the method comprising the steps of:

providing a defined tuning rule for automatably or-automated tuning of at least one operational parameter of an EOC apparatus, and automatably or automated tuning the at least one operational parameter of the EOC apparatus based on the provided tuning rule, wherein the tuning rule comprises the steps of:

a) selecting a first value and a second value of a range of values for an operational parameter of the EOC apparatus which is to be tuned;

b) applying a first processing rule to the selected first and second values of the operational parameter of the EOC apparatus according to which the selected first and second values are summed up, whereby a sum of the selected first and second values is obtained;

c) applying a second processing rule to the sum of the selected first and second values according to which the sum of the selected first and second values is divided by a divisional factor, whereby a result value is obtained;

d) determining if the EOC apparatus is operable or operated in a stable operating condition or in an instable operating condition when operating the EOC apparatus on a basis of the result value; and e) repeating steps b)-d) with the result value as the second value if it is determined that the EOC apparatus is operated in the instable operating condition when operating the EOC apparatus on the basis of the result value, or repeating steps b)-d) with the result value as the first value if it is determined that the EOC apparatus is operated at the stable operating condition when operating the EOC apparatus on the basis of the result value;

or the steps of:

a') selecting a first value denoted as value A, and a second value denoted as value B, of a range of values for an operational parameter of the EOC apparatus which is to be tuned, whereby for a first type of tunable parameters of the EOC apparatus ("Type1-parameters") the first value A is assumed to be the one, where the EOC apparatus is stable and the second value B is assumed to be the one, where the EOC apparatus is instable; or whereby for a second type of tunable parameters of the EOC apparatus ("Type2-parameters") the first value A is assumed to be the one, where the EOC apparatus is instable, and the second value B is assumed to be the one, where the EOC apparatus is stable; and assuming that the selected first and the second values A, B obey the condition: A<B;

b') applying a first processing rule to the selected first and second values A, B of the operational parameter of the EOC apparatus according to which an in-between value C is obtained as the weighted sum of the selected first value A and the selected second value B using the weights w1 and (1−w1) as: C=w1*A+(1−w1)*B, where 0<w1<1 is statically or dynamically selectable weight;

c') determining if the EOC apparatus is operable or operated in a stable operating condition or in an instable operating condition when operating the EOC apparatus on the basis of the result value C; and d') repeating steps b')-c') for Type1-parameters with the result value C as the new second value B, if it is determined that the EOC apparatus is operated in the instable operating condition when operating the EOC apparatus on the basis of the result value C, or repeating steps b')-c') for Type1-parameters with the result value C as the new first value A, if it is determined that the EOC apparatus is operated at the stable operating condition when operating the EOC apparatus on basis of the result value C.

2. The method according to claim 1, wherein the tuning rule is steps a)-e) and steps a)-e) are repeated until a stop condition is met.

3. The method according to claim 2, wherein the stop condition is met when an engine the EOC apparatus is assigned to changes its operating state.

4. The method according to claim 2, wherein the stop condition is met when a difference between the last determined first and second values exceeds above or below a predefined reference value.

5. The method according to claim 4, wherein the result value assigned to the respective first and second values exceeding above or below the predefined reference value is defined as a tuned operational parameter.

6. The method according to claim 4, wherein a predefined offset-value is applied to the respective result value which was determined from the respective first and second values exceeding above or below the predefined reference value, whereby the value resulting from the subtraction of the predefined offset-value from the respective result value which was determined from the respective first and second values exceeding above or below the predefined reference value is defined as a tuned operational parameter.

7. The method according to claim 1, wherein the tuning rule is steps a)-e) and the first value is a last determined value at which stable operation of the EOC apparatus is determined and the second value for repeating steps is a last determined value at which instable operation of the EOC apparatus is determined.

8. The method according to claim 1, wherein the tuning rule is steps a)-e) and further comprises using zero as a first initial first value.

9. The method according to claim 1, wherein the tuning rule is applied for a plurality of defined operating states of an engine to which the the EOC apparatus is assignable or assigned to.

10. The method according to claim 1, wherein the EOC apparatus comprises one or more acoustic channels and the tuning rule is applied for the one or more acoustic channels of the EOC apparatus.

11. The method according to claim 1, wherein the tuning rule is applied for at least two different engine harmonics which are to be cancelled by the EOC apparatus simultaneously.

12. The method according to claim 1, wherein the tuning rule is applied for each of a plurality of engine harmonics to be cancelled by the EOC apparatus.

13. The method according to claim 1, wherein the tuning rule is applied while driving a vehicle comprising an engine the EOC apparatus is assignable or assigned to.

14. The method according to claim 1, wherein the operational parameter which is to be tuned is the forgetting factor of the EOC apparatus.

15. An apparatus for automatably or automated tuning at least one operational parameter of an engine-order-cancellation (EOC) apparatus, the apparatus comprising:

a control unit which is configured to, particularly in accordance with the method according to claim 1:

provide a defined tuning rule for automatably or automated tuning at least one operational parameter of an EOC apparatus, automatably or automated tune the at least one operational parameter of the EOC apparatus on the basis of the provided tuning rule, wherein the control unit is configured to provide and/or implement a tuning rule which comprises the steps of:

(a) selecting a first value and a second value of a range of values for an operational parameter of the EOC apparatus which is to be tuned;

(b) applying a first processing rule to the selected first and second values of the operational parameter of the EOC apparatus according to which the selected first and second values are summed up, whereby a sum of the selected first and second values is obtained;

(c) applying a second processing rule to the sum of the selected first and second values according to which the sum of the selected first and second values is divided by a divisional factor, whereby a result value is obtained;

(d) determining if the EOC apparatus is operable or operated in a stable operating condition or in an instable operating condition when operating the EOC apparatus on the basis of the result value; and (e) repeating steps b)-e) with the result value as the second value if it is determined that the EOC apparatus is operated in an instable operating condition when operating the EOC apparatus on basis of the result value, or repeating steps b)—e) with the result value as the first value if it is determined that the EOC apparatus is operated at a stable operating condition when operating the EOC apparatus on the basis of the result value;

or the steps of:

a') selecting a first value denoted as value A, and a second value denoted as value B, of a range of values for an operational parameter of the EOC apparatus which is to be tuned, whereby for a first type of tunable parameters of the EOC apparatus ("Type1-parameters") the first value A is assumed to be the one, where the EOC apparatus is stable and the second value B is assumed to be the one, where the EOC apparatus is instable; or whereby for a second type of tunable parameters of the EOC apparatus ("Type2-parameters") the first value A is assumed to be the one, where the EOC apparatus is instable, and the second value B is assumed to be the one, where the EOC apparatus is stable; and assuming that the selected first and the second values A, B obey the condition: $A<B$;

b') applying a first processing rule to the selected first and second values A, B of the operational parameter of the EOC apparatus according to which an in-between value C is obtained as the weighted sum of the selected first value A and the selected second value B using the weights w1 and (1−w1) as: $C=w1*A+(1-w1)*B$, where $0<w1<1$ is statically or dynamically selectable weight;

c') determining if the EOC apparatus is operable or operated in a stable operating condition or in an instable operating condition when operating the EOC apparatus on basis of the result value C; and d') repeating steps b')-c') for Type1-parameters with the result value C as the new second value B, if it is determined that the EOC apparatus is operated in an instable operating condition when operating the EOC apparatus on basis of the result value C, or repeating steps b')-c') for Type1-parameters with the result value C as the new first value A, if it is determined that the EOC apparatus is operated at a stable operating condition when operating the EOC apparatus on the basis of the result value C.

16. The apparatus according to claim 15, wherein the control unit further comprises:

a selection unit for selecting a first value and a second value of a range of values for a specific operational parameter of the EOC apparatus which is to be tuned, a processing unit for applying a first processing rule to the selected first and second values of the operational parameter of the EOC apparatus so as to obtain a result value; and a determination unit for determining if the EOC apparatus is operable or operated in the stable operating condition or in the instable operating condition when operating the EOC apparatus on the basis of the result value.

* * * * *